US010926909B2

(12) United States Patent
Högl

(10) Patent No.: US 10,926,909 B2
(45) Date of Patent: Feb. 23, 2021

(54) METHOD FOR MOVING TO A REFERENCE FEED POSITION OF A LABEL TAPE AND DEVICE FOR LABELLING CONTAINERS

(71) Applicant: KRONES AG, Neutraubling (DE)

(72) Inventor: Bernhard Högl, Rohr (DE)

(73) Assignee: KRONES AG, Neutraubling (DE)

( * ) Notice: Subject to any disclaimer, the term of this patent is extended or adjusted under 35 U.S.C. 154(b) by 164 days.

(21) Appl. No.: 16/057,410

(22) Filed: Aug. 7, 2018

(65) Prior Publication Data

US 2019/0071204 A1 Mar. 7, 2019

(30) Foreign Application Priority Data

Sep. 7, 2017 (DE) ..... 10 2017 215 757.7

(51) Int. Cl.

| | |
|---|---|
| ***B32B 41/00*** | (2006.01) |
| ***B65C 9/18*** | (2006.01) |
| ***B65C 1/02*** | (2006.01) |
| ***B65C 9/00*** | (2006.01) |
| ***B65C 9/02*** | (2006.01) |
| ***B65C 9/42*** | (2006.01) |

(52) U.S. Cl.

CPC ..... *B65C 9/1865* (2013.01); *B65C 1/02* (2013.01); *B65C 9/0006* (2013.01); *B65C 9/02* (2013.01); *B65C 9/42* (2013.01)

(58) Field of Classification Search

CPC ..... B65C 9/1865; B65C 1/02; B65C 9/0006; B65C 9/02; B65C 9/42

USPC ..... 156/60, 64, 350, 351, 378, 379

See application file for complete search history.

(56) References Cited

U.S. PATENT DOCUMENTS 8,012,279 B2 9/2011 Thiel et al.

FOREIGN PATENT DOCUMENTS

| | | | | |
|---|---|---|---|---|
| EP | 1216151 | B1 | | 10/2004 |
| EP | 1663791 | B1 | | 7/2008 |
| EP | 2157020 | A1 | | 2/2010 |
| EP | 2464571 | B1 | | 6/2016 |
| GB | 2435241 | A | | 8/2007 |
| JP | 108217037 | A | | 8/1996 |
| JP | 2002326615 | A | | 11/2002 |
| JP | 2007062776 | A | * | 3/2007 |
| JP | 2014241332 | A | | 12/2014 |
| JP | 2015044616 | A | | 3/2015 |
| WO | 2015140655 | A1 | | 9/2015 |

* cited by examiner

*Primary Examiner* — Michael N Orlando
*Assistant Examiner* — Joshel Rivera
(74) *Attorney, Agent, or Firm* — McCoy Russell LLP

(57) ABSTRACT

A method for moving to a reference feed position of a label tape with respect to a dispensing edge of a container labeller and a corresponding device is described. The label tape may be first pulled back beyond the reference feed position by rewinding to its supply roller and then conveyed in the normal feed direction to the reference feed position prevents unwanted detachment of labels at the dispensing edge as a result of the label tape unwinding from the supply roller as well as the use of pusher roller systems upstream of the dispensing edge.

14 Claims, 1 Drawing Sheet

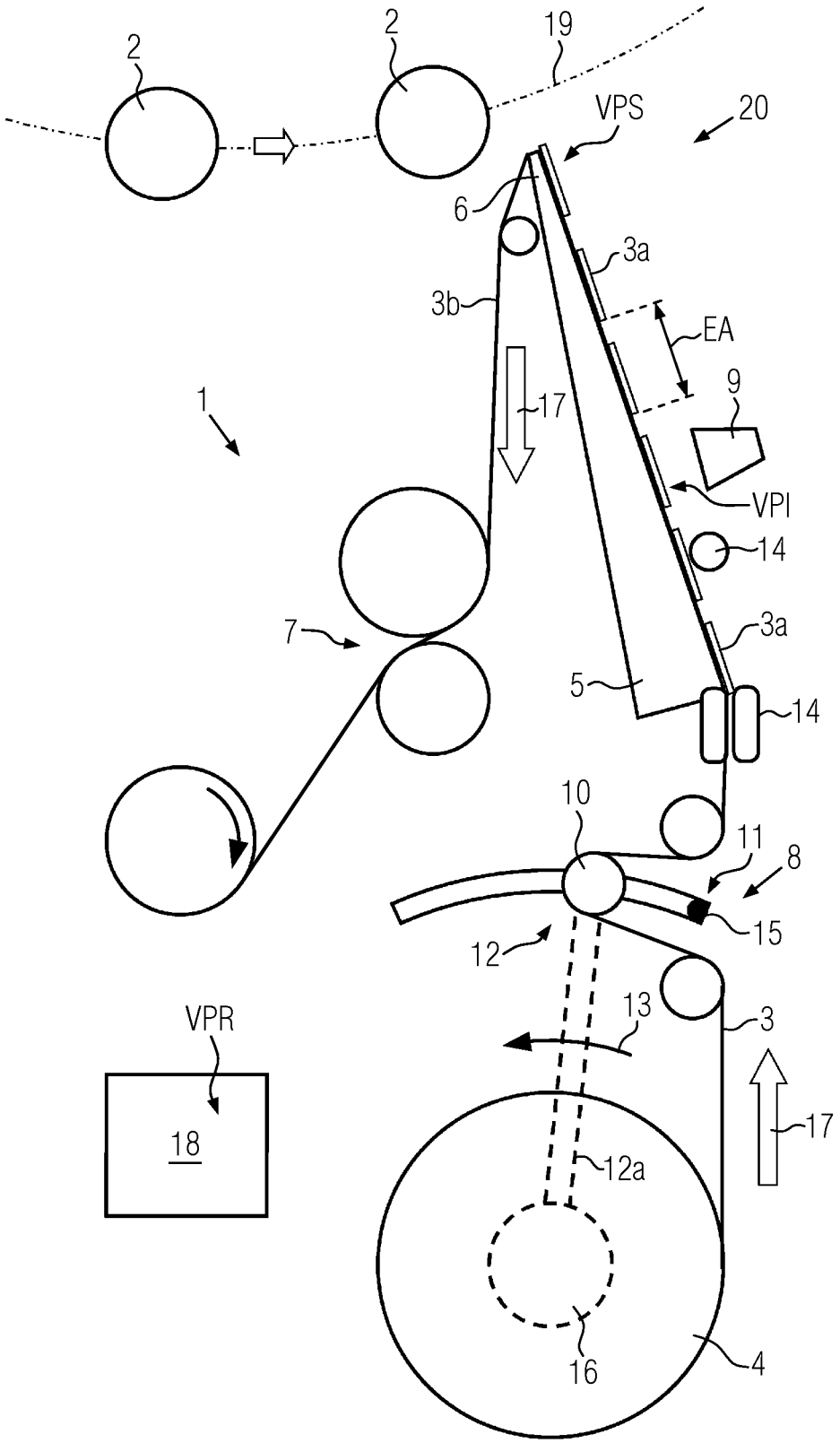
2
2
19
VPS
20
6
3a
3b
EA
9
1
17
VPI
14
7
3a
5
14
10
11
8
15
12
13
3
VPR
17
18
12a
16
4

METHOD FOR MOVING TO A REFERENCE FEED POSITION OF A LABEL TAPE AND DEVICE FOR LABELLING CONTAINERS

CROSS REFERENCE TO RELATED APPLICATION

This application claims priority to German Patent Application No. 10 2017 215 757.7 entitled "METHOD FOR MOVING TO A REFERENCE FEED POSITION OF A LABEL TAPE AND DEVICE FOR LABELLING CONTAINERS," filed on Sep. 7, 2017, the entire contents of which is hereby incorporated by reference in its entirety for all purposes.

TECHNICAL FIELD

The present disclosure relates to methods and systems for labelling containers.

BACKGROUND AND SUMMARY

For the labelling of containers, it is known that a label tape, in which self-adhesive labels are arranged on a liner at regular intervals from each other, is guided around a dispensing edge in the area of the containers so that the labels can be detached from the liner at the dispensing edge and transferred to the containers. For this purpose, the containers are transported on a carousel or along a linear conveyor section of a labeller. The dispensing edge is preferably arranged at the free end of a boom, which can be pivoted on the containers for more flexible positioning, see, for example, EP 2 157 020.

The label tape is usually moved over the dispensing edge by a draw roller system that winds up the liner downstream of the dispensing edge. Various guide devices for the label tape upstream of the dispensing edge generate a suitable tension in the label tape for feeding the label tape. According to EP 2 464 571 A1, the tape tension can also be adjusted upstream of the dispensing edge by a drive that unrolls the label tape at the input side.

Between the supply roller and the dispensing edge there may be a loop buffer for the label tape, which generates a desired tape tension upstream of the dispensing edge by means of spring tension.

The feed position of the label tape can be determined by sensors upstream of the dispensing edge, see for example EP 1 216 151 A1 and EP 1 663 791 B1. In this way, a reference feed position of the label tape can also be determined for the beginning of the labelling process. The label tape is then moved to this reference feed position before labelling and remains in this position until labelling starts.

The reference feed position can be reached by unrolling the label tape from its supply roller and monitoring the feed position of the label tape. When the label tape reaches the intended reference feed position, the feed of the label tape is stopped. Until the reference feed position is reached, however, at least one label is guided over the dispensing edge and at least partially detached from its liner. The label is then either removed by hand or falls off uncontrollably at the dispensing edge.

Alternatively, it is also possible to reach the reference feed position by retracting the label tape using a separate roller system located directly in front of the dispensing arm or dispensing edge. Such a roller system operates in labelling mode as a pusher roller system and can be driven in the opposite direction to move to the reference feed position.

The disadvantage, however, is that such pusher roller systems must be adjusted exactly to the thickness and/or material of the label tape to be transported. Such transport systems are therefore only conditionally suitable for flexible labelling with different label tapes.

There is therefore a need for improved procedures for reaching a reference feed position of label tapes and for correspondingly improved devices for labelling containers with label tapes.

The given object is solved with a method for moving a label tape to a reference feed position with respect to a dispensing edge of a container labeller. According to some aspects of the present disclosure, the label tape is first pulled back beyond the reference feed position by rewinding on its supply roller and then conveyed in the normal feed direction to the reference feed position and stopped there.

In some aspects, the label tape is wound back beyond the reference feed position, the direction of movement is reversed and the label tape is pulled over the dispensing edge by a pull roller system while moving in the forward direction to the reference feed position and stopped there.

This eliminates the cumbersome handling of labels at the dispensing edge when moving to a reference feed position by unwinding the label tape from its supply roller. In addition, label tapes of different thicknesses and/or with different mechanical properties may be easily wound back onto their supply rollers and then moved to the reference feed position under tension. No actively driven conveyor roller system between the supply roller and the dispensing edge is required to move to the reference feed position.

In one aspect, the label tape is first stored out of a loop buffer located between the supply roller and the dispensing edge until a lower adjustment limit of the buffer size is reached by rewinding and then retracting the label tape between the loop buffer and dispensing edge by further rewinding.

After reaching the adjustment limit, the conveying distance between the supply roller and the dispensing edge has a constant length. In other words, the length of the conveyor section cannot be altered by unwanted changes in the size of the loop buffer when setting the reference feed position, though it may be altered by other means. At the lower adjustment limit of the buffer size, the distance between the supply roller and the dispensing edge is known by design. This simplifies precise positioning of the label tape.

In other aspects, the actual feed position of the label tape is monitored by sensors, and conveyance of the previously rewound label tape in the normal feed direction beyond the actual feed position is automatically stopped as soon as the actual feed position for at least one label of the label tape matches the reference feed position. This allows the reference feed position to be automatically and precisely moved.

In a further aspect, the actual feed position between the dispensing edge and loop buffer is monitored. This enables a precise determination of the actual feed position and a correspondingly precise move to the reference feed position. An alternative or supplementary monitoring through the use of sensors of the actual feed position between loop buffer and supply roller is also contemplated.

In some aspects, when the buffer is discharged, at least one movable buffer roller of the loop buffer is shifted and/or swivelled to an adjustment limit against an elastic pre-tension. In labelling operation, the elastic pre-tensioning serves to produce a predetermined tape tension upstream of the dispensing edge. After moving and/or swivelling the buffer roller to the adjustment limit, a higher tape tension may be produced upstream of the dispensing edge than would be possible in normal labelling operation using the elastic pre-tension. In addition, the length of the label tape in the loop buffer is constant and known by design after reaching the lower adjustment limit.

In additional aspects, the adjustment movement of the buffer roller is elastically damped in the area of the adjustment limit. This means that the impact of an arm or carriage carrying the buffer roller is elastically damped at the adjustment limit. Alternatively, the buffer roller may be elastically deformable, e.g. made of an elastic material, or elastically supported. This prevents abrupt changes in tape tension when the adjustment limit is reached. This protects the label tape and promotes a continuous rewinding of the label tape both before and after reaching the lower adjustment limit.

In some aspects, the reference feed position is a start feed position for subsequent labelling using the label tape, or the reference feed position differs from the start feed position by a predetermined feed difference, which is an integer multiple of the label spacing (EA) on the label tape. This means that after moving to the reference feed position, the label tape may be moved to a suitable start feed position on the basis of the known label spacing by rolling the label tape from the forward roll again.

In one aspect, the device disclosed herein serves for labelling containers by means of a label tape and comprises a dispensing edge for removing labels from a liner; a roller system arranged downstream of the dispensing edge for conveying the label tape during labelling; and a supply roller for the label tape arranged upstream of the dispensing edge. According to the present disclosure, the drive direction of the supply roller for rewinding the label tape may be reversed electronically at least to a reference feed position. A controller is provided for controlling the drive of the supply roller so that the supply roller rewinds the label tape back to the supply roller beyond a reference feed position, and for controlling the roll system in such a way that the roll system then pulls the label tape in the normal feed direction to the reference feed position. The roller system is then preferably stopped when the reference feed position is reached.

Thus, for normal tape transport during labelling and for moving to the reference feed position, only the roller system operating during labelling on tension and the supply roller operating on tension during rewinding beyond the reference feed position are required. In some aspects, additional thrust roller systems are unnecessary.

Preferably, the device also includes a loop buffer located between the dispensing edge and the supply roller to maintain a predetermined tape tension when the label tape is fed during labelling. The loop buffer may compensate for variations in tape tension and/or changes in the unwinding speed of the supply roller in the labelling operation.

Preferably, the loop buffer comprises an elastically preloaded adjustment mechanism for moving and/or pivoting a buffer roller in order to tension the label tape, as well as a lower adjustment limit for the buffer size. In normal labelling operation, the loop buffer then operates passively by applying a predetermined elastic pre-tension to the tape transport, for example with the aid of a spring force.

By increasing the tape tension, the buffer roller may then be moved against the lower adjustment limit of the buffer size in order to generate a higher tape tension when the reference feed position is subsequently approached and to prevent subsequent changes in the buffer size when the label tape is rewound. This provides a simple mechanism for exact positioning of the label tape at the reference feed position.

In some aspects, the adjustment mechanism and/or the lower adjustment limit are mutually elastically damped. For example, elastic pads, springs or the like are provided at the adjustment mechanism and/or at the adjustment limit. For example, the adjustment mechanism is a swivel arm and/or a carriage on which the buffer roller may be moved along a curved or rectilinear path substantially perpendicular to the axis of rotation of the buffer roller to change the buffer size. In addition or alternatively, the buffer roller may have a radially elastic casing and/or a radially elastic bearing.

In further aspects, the buffer roller is only so elastically pre-tensioned that when the label tape is wound back onto the supply roller, the loop buffer is first reduced to the lower adjustment limit of the buffer size and then the label tape is pulled back between the dispensing edge and the loop buffer. This makes rewinding easier to control. However, it is also conceivable that the label tape between the dispensing edge and the loop buffer could already be pulled back during the reduction of the loop buffer, i.e. before the lower adjustment limit is reached.

In some aspects, the device also includes a feed sensor for monitoring an actual feed position of the label tape, particularly between the loop buffer and the dispensing edge. There, the actual feed position may be determined precisely. Alternatively, a feed sensor between the loop buffer and the supply roller is also contemplated.

In further aspects, the device also includes a control for comparing the actual feed position with the reference feed position and for controlling the roll system conveying in the normal feed direction such that the roll system is stopped when the actual feed position for at least one label of the label tape matches or differs from the reference feed position by an integer multiple of the label distance on the label tape.

This enables fully automatic positioning of the label tape at the reference feed position. The controller may then move the label tape from the reference feed position to a suitable start feed position for subsequent labelling of containers.

The set object is also solved with a container labeller, which comprises a continuously rotating carousel for transporting the containers and the device according to at least one of the embodiments described above.

BRIEF DESCRIPTION OF FIGURES

An example of the present disclosure is shown in the drawing. The only FIGURE shows a schematic top view of a corresponding labeller.

The only FIGURE shows a labelling station 1 for labelling containers 2 with a label tape 3, for which purpose the labelling station 1 comprises at least one supply roller 4 for the label tape 3 and a dispensing edge 6 arranged at the free end of a boom 5, at which labels 3*a* present on the label tape 3 (and only shown in the region of the boom 5) are detached and transferred to the containers 2.

DETAILED DESCRIPTION

Downstream of the dispensing edge 6, a roller system 7 is configured for drawing the label tape 3 in the normal feed direction 17 around the dispensing edge 6. The liner 3*b* of the label tape 3 thus runs under tension through the roller system 7 and is wound up behind the roller system in the usual manner for disposal.

Between the supply roller 4 and the dispensing edge 6, a loop buffer 8 is arranged. Between the loop buffer 8 and the dispensing edge 6 a feed sensor 9 is arranged for monitoring an actual feed position (labelled VPI in FIG. 1) of the label tape 3 with respect to the dispensing edge 6.

For example, the feed sensor 9 is an ultrasonic sensor, an optical contrast sensor, an optical print mark sensor, a line scan camera or the like. The feed sensor 9 detects the actual feed position (VPI) of individual labels 3*a*, for example by means of separate print marks on the label tape 3 and/or by printing the labels 3*a*.

Loop buffer 8 comprises at least one movable buffer roller 10 and a lower adjustment limit 11 of the buffer size, for example in the form of a mechanical stop. In normal labelling operation, the buffer size may be changed by means of an adjustment mechanism 12 by swivelling and/or shifting the movable buffer roller 10 against an elastic pre-tensioner 13 without abutting at the lower adjustment limit 11. With the aid of the pre-tensioner 13 and, if necessary, guide devices 14 for the label tape 3 provided on the labeller 1, a tape tension in the label tape 3 may be generated between the supply roller 4 and the dispensing edge 6 that is suitable for normal labelling operation.

At the lower adjustment limit 11 and/or at the adjustment mechanism 12, a stop damping 15 is preferably configured for the stop with a minimum buffer size in order to avoid jerky tension peaks in the label tape 3.

The adjustment mechanism 12 comprises, for example, a swivel arm 12 a for swivelling the buffer roller 10 (shown) or a linear slide for moving the buffer roller 10 (not shown) up to the lower adjustment limit 11.

The supply roller 4 is driven by an electrically controllable drive 16 for controlled unwinding of the label tape 3 from the supply roller 4 in normal feed direction 17. The roller system 7, the drive 16 of the supply roller 4, and the feed sensor 9 are electronically connected to a controller 18.

The controller 18 may reverse the feed direction 17 for winding the label tape 3 back to its supply roller 4 and stop the label tape 3 depending on a measurement result of the feed sensor 9, in particular on the measured actual feed position (VPI) of the label tape 3.

For this purpose, a reference feed position (labelled VPR in FIG. 1) is electronically stored in the controller 18, with which the actual feed position (VPI) is compared when the label tape 3 is rolled back to its supply roller 4.

The reference feed position (VPR) may in principle be identical to a start-feed position (labelled VPS in FIG. 1) of label tape 3 for subsequent labelling of containers 2. In one example, the reference feed position (VPR) differs from the start-feed position (VPS) by an integer multiple of the label spacing (labelled EA in FIG. 1) of labels 3*a*.

In normal labelling operation, the drive 16 of the supply roller 4 may be controlled by the controller 18 in such a way that the drive 16 supports the production of a suitable tape tension upstream of the dispensing edge 6 by braking.

In addition, the FIGURE shows a carousel 19 for transporting the container to the dispensing edge 6 by means of a pitch circle. The labelling station 1 and the carousel 19 are then in a familiar way components of a container labeller 20.

A monitoring of the actual feed position (VPI) would be complementary or alternatively also conceivable in the area upstream of the loop buffer 8. However, monitoring the actual feed position (VPI) in the area of the boom 5 is precise.

With the labeller 1, for example, you can work as follows.

In one aspect, the reference feed position (VPR) of label tape 3 may be approached before starting the labelling of container 2. For this purpose, the normal feed direction 17 of the label tape 3 is reversed and the label tape 3 is rewound to its supply roller 4.

With feed sensor 9, the actual feed position (VPI) of label tape 3 is monitored, for example using print marks on the label tape 3 and/or the position of individual labels 3*a* on the label tape 3, and transmitted to the controller 18.

Rewinding the label tape 3 causes the movable buffer roller 10 to move in the direction of the lower adjustment limit 11 until the swivel arm 12*a* or a functionally comparable linear slide preferably abuts at the adjustment limit 11 in a damped manner.

The loop buffer 8 has then reached its lower adjustment limit 11 and thus its smallest buffer size. The distance between the supply roller 4 and the dispensing edge 6 is then minimal and remains constant when the label tape 3 is rolled back to its supply roller 4. Furthermore, the tape tension may be increased when rewinding beyond the pre-tension 13 for reliable rewinding of the label tape 3 beyond the reference feed position (VPR) and for subsequent precise unwinding of the label tape 3 to the reference feed position (VPR).

The actual feed position (VPI) is continuously compared by the controller 18 with a specified reference feed position (VPR). The rewinding of the label tape 3 to its supply roller 4 is interrupted by the controller 18 as soon as the actual feed position (VPI) is suitably upstream of the specified reference feed position (VPR).

Then supply roller is switched to the normal feed direction 17 again. The rewinding of the label tape 3 from its supply roller 4 is interrupted by controller 18 as soon as the actual feed position (VPI) is identical to the specified reference feed position (VPR).

For this purpose, the roller system 7 is actively driven to pull the label tape 3 from the reference feed position (VPR) to a start feed position (VPS) with respect to the dispensing edge 6.

A suitable tape tension is generated in label tape 3 downstream of the dispensing edge 6 and between loop buffer 8 and dispensing edge 6, so that the start feed position (VPS) may be approached exactly from the reference feed position (VPR). In principle, the reference feed position (VPR) could also be identical to the start feed position (VPS).

By driving the supply roller 4 in normal feed direction 17, the loop buffer 8 may be returned to a suitable working position starting from the lower adjustment limit 11 with the aid of the elastic pre-tension 13, so that both buffer reductions and buffer enlargements are possible on this basis.

The labelling station 1 is then ready for operation and may be put into operation for the subsequent labelling of containers 2 with labels 3*a* by suitable control of the roller system 7 and the supply roller 4 in synchronisation with the carousel 19 in a manner known per se.

The terms "downstream" and "upstream" refer throughout to the normal feed direction 17 of the current labelling operation.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of the devices shown in FIG. 1. The described methods and associated actions may also be performed in various orders in addition to the order described in this application, in parallel, and/or simultaneously. The described systems are exemplary in nature, and may include additional elements and/or omit elements, or may combine the elements in different orders to achieve the same or similar purposes. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for moving to a reference feed position of a label tape with respect to a dispensing edge of a container labeller, wherein the label tape is pulled back beyond the reference feed position by being wound back onto a supply roller and is then conveyed in a normal feed direction to the reference feed position and stopped when the reference feed position is reached, wherein an actual feed position of the label tape is monitored by at least one sensor and where conveying of the label tape rewound beyond the reference feed position is automatically interrupted in the normal feed direction when the actual feed position for at least one label of the label tape corresponds to the reference feed position.

2. The method according to claim 1, wherein the label tape is stored out of a loop buffer disposed between a supply roller and a dispensing edge until a lower adjustment limit of a buffer size is reached and the label tape is then pulled back between the loop buffer and the dispensing edge.

3. The method according to claim 1, wherein the actual feed position is monitored between the dispensing edge and a loop buffer by a sensor.

4. The method according to claim 2, wherein at least one buffer roller of the loop buffer is displaced and/or pivoted against an elastic pre-tension to an adjustment limit of the buffer size.

5. The method according to claim 4, wherein a movement of the at least one buffer roller is elastically damped at the adjustment limit.

6. The method according to claim 1, wherein the reference feed position is a start feed position for labelling or differs from the start feed position by a predetermined feed difference, wherein the reference feed position is an integral multiple of a label distance on the label tape.

7. A device for labelling containers by means of a label tape, comprising:

a dispensing edge for removing labels from a liner of the label tape;

a roller system arranged downstream of the dispensing edge for conveying the label tape in a normal feed direction;

a supply roller for the label tape arranged upstream of the dispensing edge with a drive; and a feed sensor for monitoring an actual feed position of the label tape;

wherein a controller for controlling the drive of the supply roller operates the drive to wind the label tape back onto the supply roller beyond a reference feed position, and wherein the controller is programmed to compare the actual feed position monitored by the feed sensor with the reference feed position, and wherein after the label tape is wound back on the supply roller, the controller operates the roller system to pull the label tape in the normal feed direction to the reference feed position and stops the roller system when the reference feed position is reached.

8. The device according to claim 7, further comprising a loop buffer arranged between the dispensing edge and supply roller to maintain a predetermined tape tension when the label tape is fed.

9. The device according to claim 8, wherein the loop buffer comprises an elastically pre-tensioned adjustment mechanism for moving and/or pivoting a buffer roller to the label tape and a lower adjustment limit of a buffer size.

10. The device according to claim 9, wherein the adjustment mechanism and/or the lower adjustment limit is mutually elastically damped.

11. The device according to claim 9, wherein the adjustment mechanism comprises a swivel arm for swivelling the buffer roller up to the lower adjustment limit or a linear slide for moving the buffer roller up to the lower adjustment limit, wherein the swivel arm or linear slide is elastically pre-tensed only to such an extent that the loop buffer is first reduced to the lower adjustment limit of the buffer size when the label tape is wound back onto the supply roller and then the label tape is pulled back downstream of the loop buffer.

12. The device according to claim 11, wherein the feed sensor is arranged between the loop buffer and the dispensing edge for monitoring the actual feed position of the label tape.

13. The device according to claim 12, wherein the controller is programmed to compare the actual feed position monitored by the feed sensor with the reference feed position differing from a start feed position by an integer multiple of a label spacing on the label tape and wherein the controller is further programmed to stop the roller system as soon as the actual feed position for at least one label of the label tape matches or differs from the reference feed position by an integer multiple of the label spacing.

14. The container labeller with a continuously rotatable carousel for transporting the containers and the device according to claim 7.

* * * * *